US006498301B1

(12) United States Patent
Pieper et al.

(10) Patent No.: US 6,498,301 B1
(45) **Date of Patent: *Dec. 24, 2002**

(54) ELECTRICAL OR OPTICAL CABLE WITH AN IMPRINT ON THE CABLE CLADDING

(75) Inventors: Detlef Pieper, Roedental (DE); Wolfgang Baetz, Redwitz (DE)

(73) Assignee: CCS Technology, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1324 days.

(21) Appl. No.: 08/536,091

(22) Filed: Sep. 29, 1995

(30) Foreign Application Priority Data

Sep. 30, 1994 (DE) ..... 44 35 124

(51) Int. Cl.[7] ..... H01B 7/36

(52) U.S. Cl. ..... 174/112

(58) Field of Search ..... 174/112, 102 P

(56) References Cited

U.S. PATENT DOCUMENTS

| | | | | | |
|---|---|---|---|---|---|
| 4,477,400 | A | * | 10/1984 | Peerlkamp | 264/45.7 |
| 4,876,129 | A | * | 10/1989 | Akao | 428/359 |
| 5,482,655 | A | * | 1/1996 | Vogel et al. | 252/500 |
| 5,534,582 | A | * | 7/1996 | Krause et al. | 524/441 |

FOREIGN PATENT DOCUMENTS

| | | |
|---|---|---|
| GB | 1257769 | 12/1971 |

* cited by examiner

*Primary Examiner*—Dean A. Reichard
*Assistant Examiner*—William H. Mayo, III

(57) ABSTRACT

An electrical cable or an optical cable, which has a core with a cladding. An imprint is on the cladding and has the imprint formed by a plastic powder which contains copolymers of ethylene with unpolar comonomers.

19 Claims, 1 Drawing Sheet

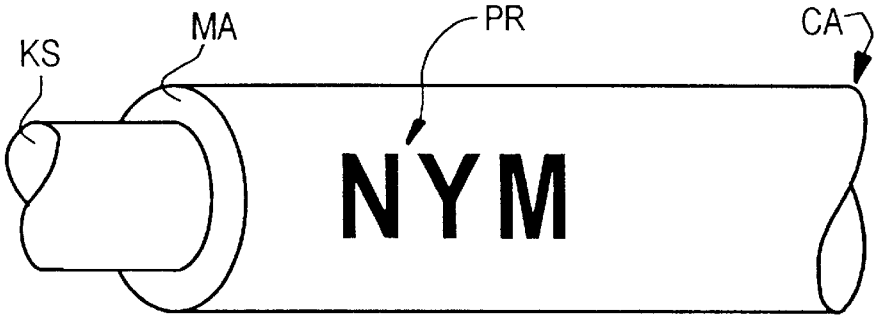
KS
MA
PR
CA
NYM

ELECTRICAL OR OPTICAL CABLE WITH AN IMPRINT ON THE CABLE CLADDING

BACKGROUND OF THE INVENTION

The present invention is directed to a cable which can be used either as an electrical cable or optical cable and has a cladding that comprises imprints produced from a plastic powder.

British Patent No. 1,257,769, which claims priority from German Application 19 51 597, discloses a cable which has imprints on a cable cladding or sheath. The raised imprints are formed by sintering a plastic powder on the cable cladding, and this powder should be selected as close as possible to or the same material as the cable cladding. White or chromatically pigmented low-density polyethylene (LDPE) powders are usually used for the black LDPE claddings, which are resistant to stress tears and are usually employed as a cladding. For example, plastic powders that are known under the tradenames "PECMA 200" or "CEVAM", which is an acrylic acid copolymer sold by Interorgana of Stuttgart, Germany, are used as products for the imprinting.

In addition to having a good workability and adequate adhesion, the plastic powders used for the imprinting must be of such a nature that they do not lead to any stress cracks. Mechanically, the imprinting of the respective identifier to be applied on the cable cladding or sheath represent a certain intervention that intrinsically harbors the risk of forming stress cracks.

SUMMARY OF THE INVENTION

The present invention is based on the object of creating a plastic powder suitable for the imprinting, wherein the protection of the cable cladding against the formation of stress cracks is also assured to the farthest-reaching extent possible in addition to providing a good workability.

To accomplish these objects, the invention is directed to an improvement in a cable having a core with a cable cladding that comprises imprints manufactured of a plastic powder. The improvement is achieved in that the plastic powder contains copolymers of ethylene with unpolar comonomers.

The plastic powder, which is constituted according to the present invention, can be easily worked, yields good adhesion and, as investigations have shown, harbors far less of a risk of forming stress cracks.

Suitable copolymers of ethylene with unpolar comonomers for the inventive plastic powder are preferably commercially available as linear low density polyethylene (LLDPE) as well as very low density polyethylene (VLDPE). For example, powders offered under the tradenames "ATTANA" and "ENGAGE POP" as well as "ENGAGE POE" of Dow Chemical as well as "CLEARFLEX" of ENI-Chemie are particularly suitable. Altogether good results with respect to the resistance to stress cracks were capable of being achieved in tests with the aforementioned materials.

Linear polyethylenes that, in particular, contain alpha olefins, preferably alpha-olefin propene, butene, hexene, octene and mixtures thereof as comonomers are preferably employed.

The proportion of comonomers within the plastic powder should be advantageously selected so that the reduced density of the ethylene copolymer caused by the comonomers is less than or equal to 0.92.

Various additives can also be added to the plastic powder within the scope of the invention, especially those for optimizing the adhesion, such as, for example, ethylene copolymers with polar comonomers, such as ethylene vinyl acetate (EVA) copolymers.

Additional stabilizers against heat and/or light as well as potentially anti-oxidants can also be advantageously added to the plastic powder of the invention. Including chromatic pigments into the plastic powder for improving the visibility or the legibility of the imprint is also expedient.

The plastic powder of the invention should expediently have a grain fineness with a grain diameter in a range of 50 $\mu$m through 200 $\mu$m.

Other advantages and features of the invention will be readily apparent from the following description of the preferred embodiments, the drawing and claims.

BRIEF DESCRIPTION OF THE DRAWING

The FIGURE is a partial perspective view of a portion of a cable having an imprint in accordance with the present invention.

DESCRIPTION OF THE PREFERRED EMBODIMENTS

The principles of the present invention are particularly useful on a cable, generally indicated at CA in the Figure. The cable CA, which is schematically illustrated, has a cable core KS which is surrounded by a cable cladding MA, which is preferably composed of polyethylene. An imprint, generally indicated at PR of a powder which contains a copolymer of ethylene as well as one or more unpolar comonomers is pressed into the surface of the cable cladding MA.

The suitable copolymers of ethylene with unpolar comonomers for the inventive plastic powders are preferably commercially available as linear low density polyethylenes or very low density polyethylenes. As mentioned above, linear polyethylenes that, in particular, contain alpha olefins, preferably alpha-olefin propene, butene, hexene, octene and mixtures thereof as comonomers are preferably employed.

A comparative test shall be described below for illustrating the advantages achieved with the present invention.

A very low density polyethylene of ENI-Chemie sold under the tradename "CLEARFLEX MPDO" with an MFI (melt flow index) of 190°/2.16 of 7.5 and a density of 0.90 g/cm$^3$ was selected. The linear low density polyethylene as well as the very low density polyethylene are distinguished by a high resistance to stress cracks, as well as at the high melt flow indices required for a good sintering. This was first tested at the selected specimen with plate samples (test for resistance to stress cracks according to DIN VDE 0472, Part 810), whereby not a single specimen break, either tempered or untempered, occurred up to 1000 hours of testing time. The VLDPE ("CLEARFLEX") employed proved comparable in resistance to stress cracks to the material of the cable cladding and clearly more resistant to stress cracks than the initially-cited marker powders, which exhibit 100% failure rate within 24 hours in this test.

In detail, one proceeds as follows in the manufacture of the inventive plastic powder:

The VLDPE ("CLEARFLEX MPDO") colored white with 2 weight % of a PE color concentrate was ground in a laboratory mill and subsequently sieved. For simulating the marking in the cable manufacture, bands having the dimension 20·2.5 mm were extruded from a commercially-obtainable low density polyethylene cable cladding material.

The marker wheel respectively ran along on the upper side or surface of the band for marking with the marker powder. The pressing power or force for pressing, inserting or embedding the imprint into the surface of the cladding material was composed of the dead weight of the marking wheel. The units under test were punched from the bands in the extrusion direction. The following tests were performed on the finished specimens as well as other specimens whose powder did not comprise the inventive composition and used "Pecma" as the powder:

| | "CLEARFLEX" coating | "PECMA" coating |
|---|---|---|
| Stress crack formation VDE 0472 Part 810 (70° C. tempering)* | No failures after 1000 h | 100% failure rate after 48 h |
| Abrasion test according to FTZ 7 PS 5 3.2 | passed | passed |

The following composition of the plastic powder used for the markings are to be viewed as especially advantageous within the scope of the invention:

1) Copolymers of ethylene with propylene, butene, hexene and/or octene as unpolar comonomers. Density of ≦0.92, preferably in a range of 0.90 through 0.91. Melt flow index in a range between 3 and 25 (MFI 190° C./2.16 kg).
2) Addition of stabilizers, such as anti-oxidants (for example Irganox 1010), light protection means, for example HALS stabilizer ("Hindered Amine Light Stabilizer") below 5 weight %, preferably below 1 weight %.
3) Addition of chromatic pigments below 5 weight %.

Mixtures having this preferred composition were ground to a grain fineness suitable for the marking. A grain fineness between 50 μm and 200 μm is preferred. The application expediently occurred in on-line operation with a marking wheel on the molten PE cladding simultaneously with the extrusion of the cladding.

Although various minor modifications may be suggested by those versed in the art, it should be understood that we wish to embody within the scope of the patent granted hereon all such modifications as reasonably and properly come within the scope of our contribution to the art.

We claim:

1. A cable comprising a core with a cable cladding, said cladding having an imprint of a plastic powder pressed into a surface of the cable cladding by a marking wheel under pressure power, the plastic powder containing copolymers of ethylene with at least one unpolar comonomer.

2. A cable according to claim 1, wherein the copolymers of ethylene include linear polyethylene.

3. A cable according to claim 2, wherein said linear polyethylene contains a comonomer selected from a group consisting of alpha-olefins and mixtures of alpha-olefins.

4. A cable according to claim 3, wherein the alpha-olefins are copolymerized from a material selected from a group consisting of propene, butene, hexene and octene.

5. A cable according to claim 1, wherein the copolymers of ethylene have a reduced density caused by the at least one comonomer and said density is selected to be equal to or less than 0.92.

6. A cable according to claim 1, wherein the plastic powder contains additives for optimizing adhesive properties of the powder, said additives including ethylene copolymers with polar comonomers.

7. A cable according to claim 6, wherein the ethylene copolymers with polar comonomers are composed of ethylene vinyl acetate.

8. A cable according to claim 1, wherein the plastic powder contains known stabilizers against heat.

9. A cable according to claim 1, wherein the plastic powder contains a colored pigment uniformly worked into the plastic powder.

10. A cable according to claim 1, wherein the plastic powder is produced by grinding.

11. A cable according to claim 1, wherein the plastic powder contains a grain fineness with a grain diameter in a range of 50 μm through 200 μm.

12. A cable according to claim 1, wherein the plastic powder includes heat stabilizers and colored pigments uniformly distributed in the plastic powder, said powder having a grain diameter in a range of 50 μm through 200 μm.

13. A cable according to claim 1, wherein the cable is an electrical cable.

14. A cable according to claim 1, wherein the cable is an optical cable.

15. A method for marking a cable comprising the steps of:

providing a plastic powder of a copolymer of ethylene with at least one unpolar comonomer;

extruding a cable sheath of a material different from said plastic powder on said cable; and pressing said plastic powder into a surface of said cable sheath as embedded markings for said cable sheath.

16. A method according to claim 15, wherein the plastic powder includes heat stabilizers and colored pigments uniformly distributed in the plastic powder, said powder having a grain size of a grain diameter in a range of 50 μm through 200 μm.

17. A method according to claim 15, wherein the copolymers of ethylene include linear polyethylene.

18. A cable according to claim 17, wherein a copolymerization of the linear polyethylene is taken with alpha-olefins as a comonomer, and the alpha-olefins are copolymerized from a material selected from a group consisting of propene, butene, hexene and octene.

19. A cable comprising a core with a cable cladding, said cladding having a surface with an imprint of a plastic powder inserted into the surface, said plastic powder containing copolymers of ethylene with at least one unpolar comonomer.

* * * * *